US005325614A

United States Patent [19]

Rosen

[11] Patent Number: 5,325,614

[45] **Date of Patent: * Jul. 5, 1994**

[54] ADJUSTABLE FIT SHOE CONSTRUCTION

[76] Inventor: Henri E. Rosen, 229 Coolidge Ave., Watertown, Mass. 02172

[ * ] Notice: The portion of the term of this patent subsequent to Sep. 7, 2010 has been disclaimed.

[21] Appl. No.: 40,640

[22] Filed: Mar. 31, 1993

Related U.S. Application Data

[63] Continuation-in-part of Ser. No. 861,114, Mar. 31, 1992, Pat. No. 5,241,762.

[51] Int. Cl.[5] ..... A43B 3/26

[52] U.S. Cl. ..... 36/97; 36/88; 36/93

[58] Field of Search ..... 36/97, 43, 44, 71, 29, 36/28, 153, 88, 93

[56] References Cited

U.S. PATENT DOCUMENTS

| | | | |
|---|---|---|---|
| 1,193,608 | 8/1916 | Poulson | 36/153 |
| 2,537,156 | 1/1951 | Pennell | 36/43 |
| 2,981,010 | 4/1961 | Aaskov | 36/29 |
| 3,914,881 | 10/1975 | Striegel | 36/153 |
| 4,009,528 | 3/1977 | Villari, Jr. et al. | 36/29 |
| 4,361,969 | 12/1982 | Vermonet | 36/29 |
| 4,446,634 | 5/1984 | Johnson et al. | 36/29 |
| 4,458,430 | 7/1984 | Peterson | 36/153 |
| 4,577,417 | 3/1986 | Cole | 36/28 |
| 4,744,157 | 5/1988 | Dubner | 36/93 |
| 4,995,173 | 2/1991 | Spier | 36/93 |
| 5,060,402 | 10/1991 | Rosen | 36/93 |
| 5,241,762 | 9/1993 | Rosen | 36/97 |

*Primary Examiner*—Steven N. Meyers
*Attorney, Agent, or Firm*—Bruce F. Jacobs

[57] ABSTRACT

A shoe construction is disclosed in which varying the width of an insole assembly by means of a fluid-containing bladder adjusts the fit of the shoe.

10 Claims, 6 Drawing Sheets

FIG. 13
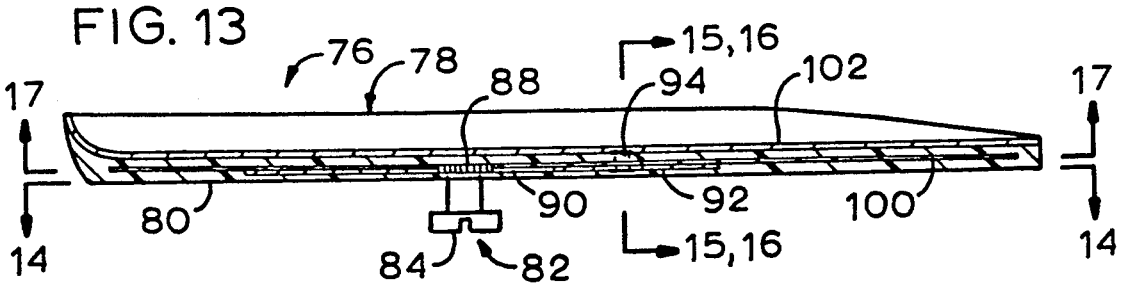
FIG. 14
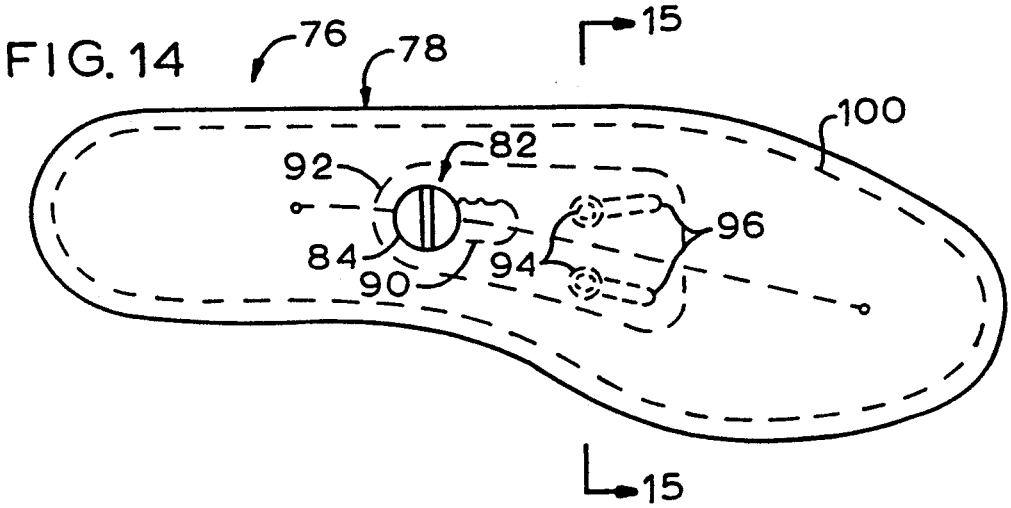
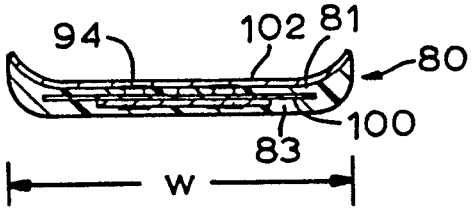
FIG. 15
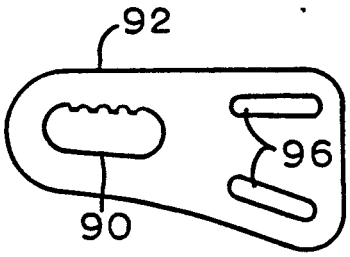
FIG. 17
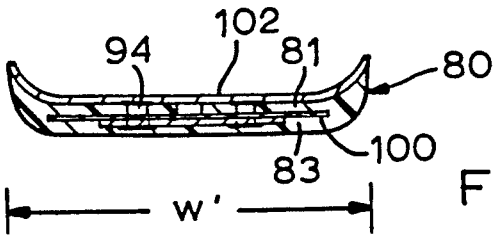
FIG. 16

ADJUSTABLE FIT SHOE CONSTRUCTION

This is a continuation-in-part of copending application Ser. No. 7/861,114 filed on 31 Mar. 1992.

BACKGROUND OF THE INVENTION

The need for improved means of girth adjustment in footwear is accepted in the industry as continually more offerings are being limited by market economics to single widths for each size in length. Studies, including those of the U.S. Army QMC, have shown that such single width shoes afford only an approximate fit to less than a third of the populace. Furthermore, even this third receives less than a precise fit given the normal diurnal foot girth variation that occurs with changes of fluid concentration in the extremities, usually resulting in daily girth change ranges of up to two full width increments with even wider ranges experienced when there are concurrent changes in weather, altitude or a wearer's physical condition.

The usual girth adjustment means including laces, buckles, touch fasteners and lately pressurized air and dial operated cables, not only present design limitations, but generally cannot be used in the fit-critical ball area where they would tend to inhibit the comfortable flexing of the foot in this region during the stride cycle. Furthermore, these usual girth adjustment means are not suitable for use with many shoe styles.

While this inventor's recent inventions disclose practical means of shoe girth adjustment, none of these, including U.S. Pat. Nos. 4,967,492, 5,036,604 and 5,060,402, provide such means applicable to the manufacture of unlined footwear adaptable to a wide range of conventional shoe bottom styles, including those having the usual die-cut leather or composition soles.

Past attempts to deal with shoe girth adjustment by variation of insole elements have been limited to variation in the thickness of such elements. Such approaches not only do not afford the infinite adjustability in the adjustment range preferred for optimum fit, but more importantly, present serious orthopedic risks. The latter occur when insole elements of appreciably different thicknesses are needed to provide proper fit to a wearer whose feet are of substantially different width, as not infrequently occurs. Such adjustment, given that the wearer's legs are of substantially equal length, results in one foot being higher from the walking surface than the other, often leading to serious orthopedic problems over time. Shoes having such insoles of varied thickness include those offered by Toddler's University, Inc. of Westport, Conn. and others.

Accordingly, it is one of the objects of the present invention to provide means for adjusting the fit of a shoe wherein the shoe upper is either unlined or has a conventional cement-attached lining and the shoe bottom is any conventional shoe bottom or sole assembly.

It is a further object to provide an adjustment means which does not change the actual girth of the shoe in all of the critical fitting areas thereof, including the midportions of the shoe known as the ball, waist and instep portions and does not change the distance of the foot from the walking surface.

It is a further object to provide an adjustment means which is substantially unobtrusive so as to not affect the appearance of the shoe.

It is still another object to provide an adjustment means which is infinitely adjustable over a designed fit range.

A further object is to provide a fit adjustment means easily adaptable for use in unlined shoes with the widest possible choice of conventional sole and/or bottom materials and where such means can be either built into the shoe at its manufacture or inserted therein after manufacture.

It is also an object to provide an adjustment means which is operably adjustable when the shoe is on the foot.

SUMMARY OF THE INVENTION

Accordingly, the present invention is directed to a shoe having an adjustment means for use in an otherwise conventional shoe, which operates by changing the fit of the shoe without changing the girth of the cavity defined by shoe upper and the adjustment means disposed on the shoe bottom. Girth in this application is defined as the transverse circumference of the shoe at a particular portion of the shoe at about its midportion, which is the portion between the toe and heel regions, and including the ball, waist, and instep portions. The cavity formed by the upper and the adjustment means and bottom member may be either continuous or discontinuous when laces or ties are being used.

The adjustment of the fit of the shoe is accomplished by employing an adjustment means placed within the shoe enclosure formed by the shoe upper and bottom members, which is capable of causing change in the dimensional relationship between the width and fitting height inside the shoe cavity. The fitting height is the vertical distance between the adjustment means in the cavity and the uppermost inside portion of the upper, which in shoes such as the loafer style of the drawings is the plug, directly above the adjustment means. Specifically, by causing the sides of the upper to move outwardly apart from each other the plug or top portion of the upper moves downwardly reducing the fitting height. In contrast, when the sides of the upper move inwardly the plug moves upwardly increasing the fitting height. Since both the upper and bottom are generally nonstretchable, no change occurs in the inside and outside circumferences of the shoe during such adjustments. The adjustment procedure, however, enables one to create a snug fit between the top of the foot and the upper portion of the upper. This fit adjustment parameter is critical to the fit of the shoe while snugness or fit at the sides of the upper is not.

In one embodiment of the present invention, the adjustment means comprises a self-adjusting insole assembly disposed within the shoe cavity. It offers infinite adjustment over the designed fitting range of the shoe. This embodiment is of particular interest for children's shoes and other shoe categories where the wearers either cannot or prefer not to make the necessary adjustments themselves.

Another embodiment is directed to the use of separate removable inserts in place of a single self-adjusting insert.

In still another embodiment according to the present invention, the adjustment means comprises an adjustable insole assembly wherein width adjustment is effected by the manual turning of a coin-slotted screw, preferably from the outside of the shoe when it is on the foot. The rotational turning of the screw adjusts the width of the insole assembly by use of such as a rack and pinion adjustment means, whereby a pinion gear in the end of an adjusting screw operates in and with a rack opening in a slidably movable adjustment plate element, all of which are inter-connected within the insole assembly.

Another embodiment offering similar self-adjustment for similar end use comprises shoe construction having an integral girth adjusting insole assembly system preferably built into the shoe at manufacture but optionally as a separate insertable assembly for use therewith. This embodiment also has the unique advantage of limiting any appreciable deformation of the shoe's outer shell or upper to those times when the shoe is fully weight-bearing, the upper tending to maintain its original "lasted" contours as manufactured at point of sale and when not in use.

All the embodiments of the invention are similar in that they all use insole assemblies that are substantially planar in their weight-bearing areas, which planar areas are of constant thickness. As a result, orthopedic risks associated with changing the height of one foot relative to the other are avoided.

For a fuller understanding of the nature and objects of the present invention, reference should be made to the following detailed description taken in connection with the accompanying drawings.

BRIEF DESCRIPTION OF THE DRAWINGS

FIG. 13 is a side-elevational cross-sectional view of the insole assembly of FIG. 12, taken on line 13—13.

FIG. 14 is a plan view of the insole assembly of FIG. 13 taken on line 14—14.

FIG. 15 is a transverse cross-sectional view of the insole assembly of FIG. 13 and 14 taken on line 15—15.

FIG. 16 is another transverse cross-sectional view of the insole assembly of FIG. 11 taken on line 16—16.

FIG. 17 is a plan view of the adjustment plate of the insole assembly.

DETAILED DESCRIPTION OF THE INVENTION

Figure 1:
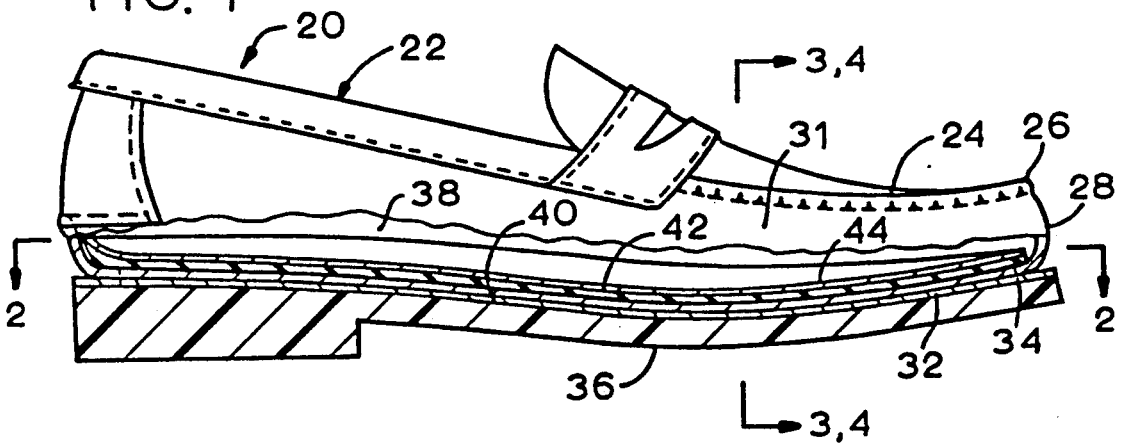
FIG. 1 is a side-elevational cross-sectional view of a shoe of the present invention.

Referring to the drawings, the improved shoe construction of the present invention will be described with reference to a shoe of the well-known loafer design. It should however be understood that this is being done for ease of reference and that the invention is not limited to use in such a shoe style.

In various embodiments described hereinafter, like reference numerals refer to like members which function in the same or similar manner.

Referring to FIGS. 1–4, shoe 20 generally comprises an upper 22 having a plug 24 attached at sewn seam 26 to vamp 28. The vamp 28 corresponds to the side and bottom portions of the upper and the plug 24 corresponds to the top portion of the upper 22. Seam 26 extends substantially around the toe and along the sides of the midportion of upper 22, which is in turn secured to midsole 32 by stitching 34. Midsole 32 is also secured to unitsole or bottom assembly 36 by adhesive cement or other conventional means. Upper 22 and bottom 36 and the uppers and bottoms described in this and other embodiments hereinafter may be made of any of the conventional materials used in the manufacture of shoes. For example, the upper may be made of leather, imitation leather, woven and non-woven fabrics and combinations thereof, while the bottoms may be made of materials such as leather, leatherboard, and plastics including rubber, polyvinyl chloride, polyurethane, ethylene vinyl acetate, and combinations thereof.

Shoe 20 further comprises an adjustment means comprising an insole assembly 38 that is substantially planar, and disposed within shoe 20 adjacent to the top surface 40 of bottom 36. The insole assembly may be either permanently fastened in the shoe 20 by suitable means such as adhesive cement or it may be removably disposed in the shoe. Permanent attachment is, however, presently preferred. The insole assembly 38 comprises an insole base 42 with an optional socklining 44 attached thereto by suitable means such as adhesive cement, heatsealing or thermo-welding, or molding therewith. Socklining 44 can be made of any of a number of materials conventionally used for such elements including the DriLex® woven fabrics distributed by Faytex Inc. of Weymouth, Mass. Insole base 42 is preferably molded with non-planar peripheral edge contours of any of number of flexible plastic materials having a relatively high degree of memory and tendency to return to their originally molded contours whenever deformed therefrom. Such materials include compounds of rubber, polyurethane, and the like. Optionally, thin springs (not shown) stamped and formed out of thin spring tempered steel, stainless steel, or beryllium copper plate can be molded within or otherwise attached to said insole assemblies to improve the spring rate of their memories if so desired.

Figure 2:
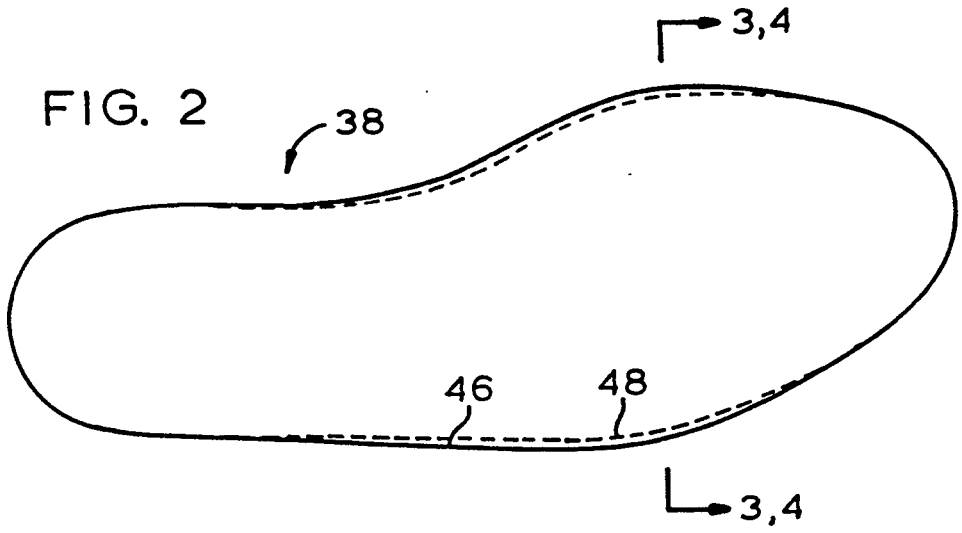
FIG. 2 is a plan view of the insole assembly used in the shoe of FIG. 1 taken on line 2—2.
Figure 3:
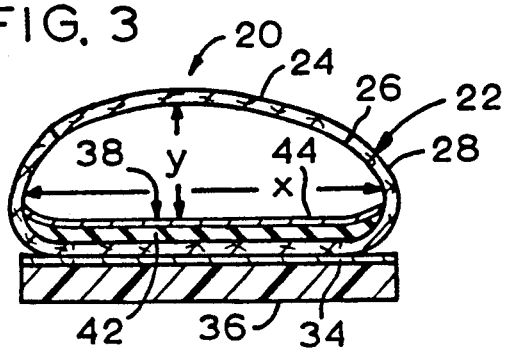
FIG. 3 is a transverse cross-sectional view of the shoe of FIG. 1 taken on line 3—3.
Figure 4:
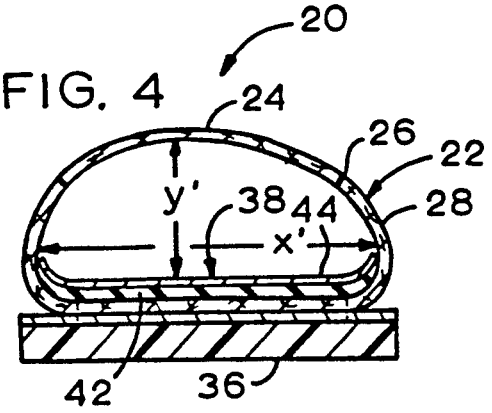
FIG. 4 is a transverse cross-sectional view of the shoe of FIG. 1 taken on line 413 4.

The insole assembly 38 automatically adjusts the fit of the shoe to the particular foot disposed in the shoe cavity 31 over a designed fit range. As best shown in FIGS. 3 and 4, the shoe 20 is in two different fit conditions. In FIG. 3, the shoe 20 is shown in the condition it would be in when placed on a foot of relatively narrow girth, the foot of narrow girth being relatively short in height. In order to accommodate such a foot, the side marginal edges 46 of the insole assembly 38 are normally in an outwardly bent position forcing the side portions of vamp 28 of the upper outward. This action in turn causes the plug portion 24 of upper 22 to move correspondingly downward so that it can fit more snugly against the top of the forepart of the foot. FIG. 4 shows the same shoe, but in a fitting condition suitable for fitting a relatively wider girth foot, such a foot being not only wider, but also vertically thicker and thus requiring a greater fitting height than is the case with the relatively slimmer and vertically thinner foot of FIG. 3. As a result, the insole assembly does not force the side portions 28 of the upper outwardly as much as in FIG. 3 and thus the fitting height y' of FIG. 4 is greater than the fitting height y in FIG. 3. The width x' of FIG. 4, however, is less than the width x in FIG. 3. Since neither the upper 22 nor the bottom member 36 is stretchable, the circumference of the oval formed by the upper, adjustment means and bottom member remains constant. FIG. 2 shows the outline of the insole assembly 38 as it appears in FIGS. 3 and 4, with line 46 showing the wider configuration of FIG. 3 and dashed line 48 the narrower configuration of FIG. 4.

The difference in insole assembly width between the two extremes is not excessive, or large enough to impair the appearance of the shoe; e.g., ⅛" overall width differential being sufficient for a fitting range of several consecutive standard width increments.

Figure 5:
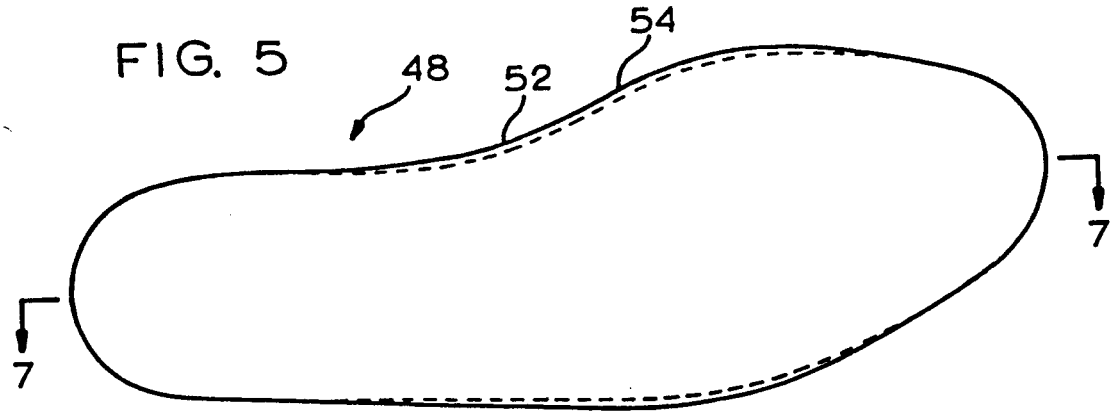
FIG. 5 is a plan view of another insole assembly of the present invention.
Figure 6:
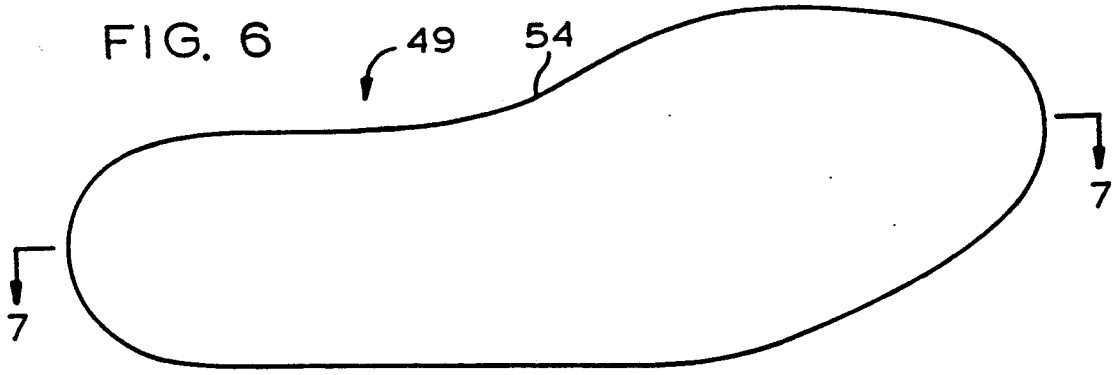
FIG. 6 is another plan view of an insole assembly of FIG. 5.
Figure 7:
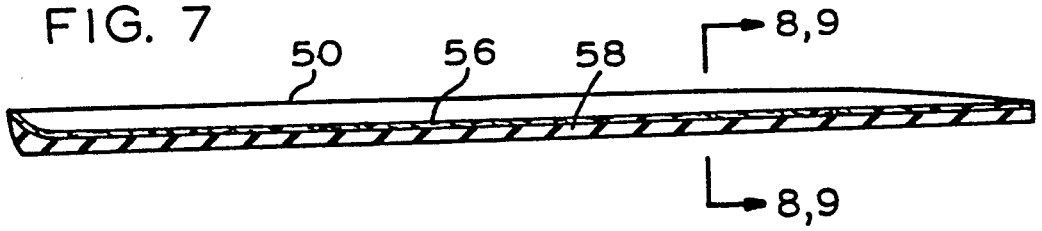
FIG. 7 is a side-elevational cross-sectional view of the insole assemblies of FIGS. 5 and 6 taken on line 7—7.
Figure 8:
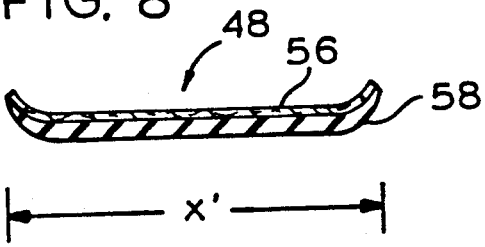
FIG. 8 is a transverse cross-sectional view of the insole assembly of FIG. 7 taken on line 8—8.
Figure 9:
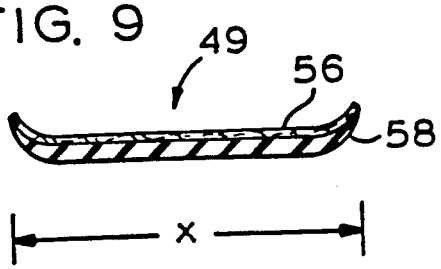
FIG. 9 is a transverse cross-sectional view of the insole assembly of FIG. 7 taken on line 9—9.

FIGS. 5–9 illustrate another embodiment of the present invention. Referring to the drawings, FIGS. 5 and 6 show two separate inserts 48 and 49 which could represent extremes in midportional width covering a girth range of several consecutive shoe width increments. In this embodiment, separate inserts such as inserts 48 and 49 are used instead of a single insole assembly 38 as in FIGS. 1–4. The inserts, while being substantially equal in thickness, are of different widths. By inserting the correct insert having the proper width in a shoe, it will adjust the fitting height to the proper dimension to create a snug fit in the fit/critical area between the top of the foot and the plug or top portion of the upper. FIG. 8 shows a relatively wide insert 48 with a width x' and FIG. 9 shows insert with a relatively narrower width x. The mechanism of action is the same as described in connection with FIGS. 1–4 with outward displacement of the side portions of the upper drawing the top portion of the upper downward. FIG. 5 shows insole assembly 48 with solid line 52 representing its periphery and midportional width, as compared with dashed line 54, which represents the midportional width of the narrower extreme, shown in plan in FIG. 6 as the continuous peripheral line 54. As shown in FIGS. 7–9, each insole assembly insert comprises an insole base 58 and an optional socklining 56. Typically, insole base 58 is molded of a high durometer rubber or more likely a high density polyethylene such as from compounds available from Quantum Corp. of Cleveland, Ohio, and others. It is important that this base is relatively firm so that it can force the side portions of the upper outwardly without said base deforming from resistance therefrom. The optional socklining 56 can be of any of a number of materials, including leather, with the DriLex® woven fabrics distributed by Faytex of Weymouth, Mass. the preferred material, being bonded in use to base 58 by conventional cement adhesives. Separate insole assemblies of this embodiment are of substantially the same thickness. As is apparent, one must have a set of a variety of different sized inserts to afford incremental fit adjustment. To achieve proper fit, the user must choose the proper insert as opposed to the automatic and non-incremental infinite adjustment offered by the embodiment of FIGS. 1–4.

Another and preferred embodiment of the present invention is illustrated in FIGS. 10–17. Referring to the drawings, shoe 60 generally comprises upper 62 having a plug 64 attached at sewn seam 66 to vamp 68. Seam 66 extends substantially around the toe and along the midportion of upper 62, which is secured to midsole 70 by stitching 72. Midsole 70 is in turn secured to unitsole or bottom member 74 by suitable means such as adhesive cement or stitching. Disposed within the interior of shoe upper 62 is adjustment means 76 generally comprising insole assembly 78.

Figure 10:
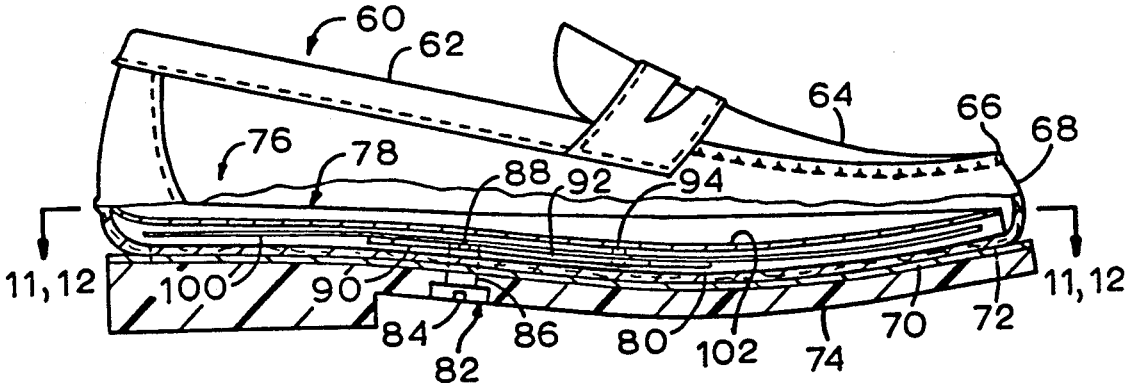
FIG. 10 is a side-elevational cross-sectional view of another shoe of the present invention.

Insole assembly 78 comprises insole base 80 having a transversely movable top portion 81 and a relatively immovable lower portion 83, adjusting screw assembly 82, comprising coin-slotted screw head 84 on screw shaft 86 which has a pinion gear 88 at its upper end. An optional inside screw head on the interior of the shoe and attached to the top of pinion gear 88 (not shown in the drawings) would allow optional adjustment from within the shoe with the shoe off the foot. However, the preferred outside adjustment means allows adjustment both when the shoe is on as well as off the foot. The pinion gear acts together with a rack 90 in the plate 92 to adjust the longitudinal position of movable adjusting plate 92. Rivets 94, which travel in angled slots 96 in the adjusting plate 92 are connected to the top transversely movable portions of base 80. The top 81 and bottom 83 portions of the insole base 80 are connected only around its peripheral edge, with the top midportion thereof free to move transversely relative to the bottom portion on the separating planar surface 100. This surface 100 extends within the peripheral edge connections, and separates the top from the bottom midportions of the insole base 80, excepting at the peripheral connections thereto. The midportion of the top portion 81 of insole base 80 contains a slit/slot 98, which allows for the width adjustment of the base 80, by permitting the midportion of the top portion 81 to move transversely along surface 100 of bottom portion 83. As best shown in FIGS. 10 and 13, stretchable socklining 102 is fastened to the top peripheral edges of insole base 80, preferably by adhesive cement, heat-sealing or the like. Socklining 102 is preferably of stretchable spandex fabric, such as the DriLex® fabric supplied by Faytex Inc. of Weymouth, Mass.

Figure 11:
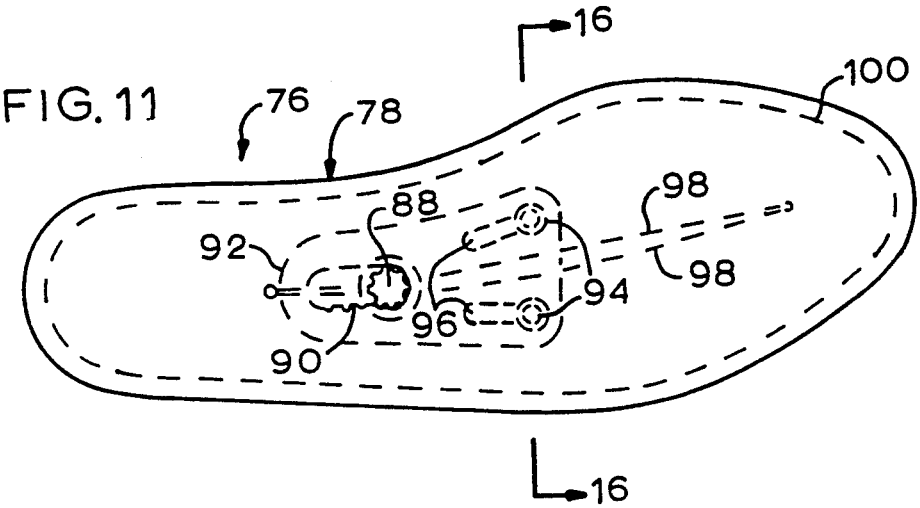
FIG. 11 is a plan view of the insole assembly used in the shoe of FIG. 10, taken on line 11—11, but showing adjustment plate moved toward the heel.
Figure 12:
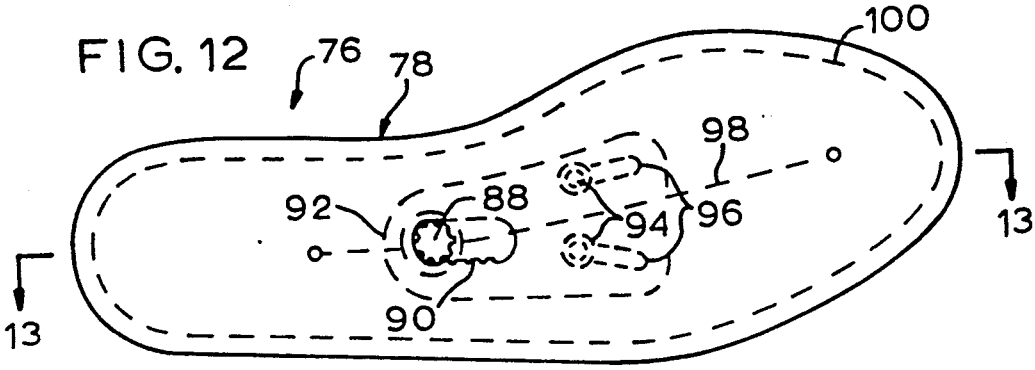
FIG. 12 is another plan view of the insole assembly used in the shoe of FIG. 10, taken on line 12—12.
Figure 18:
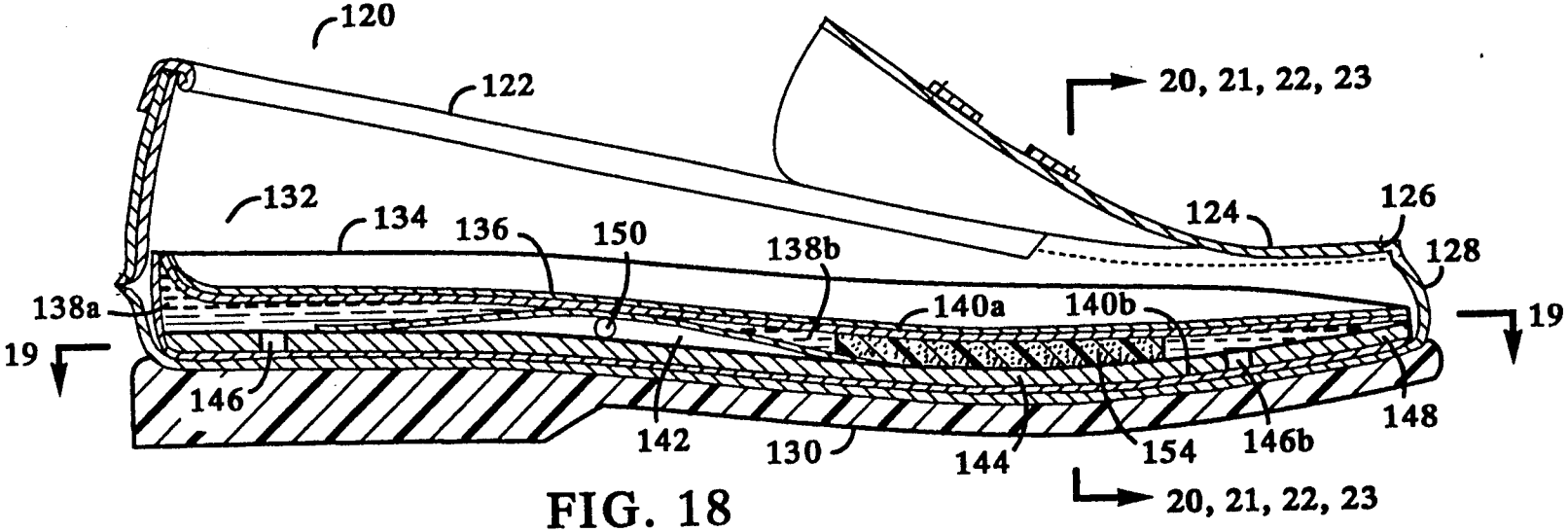
FIG. 18 is a side elevational cross-sectional view of another embodiment of a shoe of the present invention.

The operation of the adjustment means 76 is best understood by reference to the drawings. As shown in FIG. 11, plate 92 has been adjusted to its most rearward position, closest to the heel end of the shoe, in which position the angled slots 96 in plate 92 have forced the rivets 94 outwardly thereby widening the longitudinal opening 98 to its widest separation. FIG. 12 shows the insole assembly 78 of the shoe of FIG. 10 at its narrowest widthwise adjustment wherein plate 92 has been moved forward by having turned the coin-slotted adjusting screw 84 in a counter-clockwise rotation. In this position, the slots 96 in plate 92 bring the rivets 94 to their closest separation within the midportional top portion 81 of the insole base 80, thereby narrowing the base 80 to its narrowest adjustment wherein the longitudinal opening 98 is a slit, rather than the slot of FIG. 11. FIG. 13 shows the adjustment means 76 of shoe 60 comprising insole assembly 78 and showing assembly 78 with adjusting screw assembly 82 therewith, as they might appear prior to their inclusion in shoe 60, preferably during its manufacture. FIG. 14 shows a view of the insole assembly 78 of FIG. 13 as it would appear viewed from below on line 14–14. FIG. 15 shows insole assembly of FIG. 14 adjusted to its narrowest setting also shown in FIG. 12, while FIG. 15 shows the same assembly at its widest adjustment, corresponding to that shown in FIG. 11. It will be noted that the width w of FIG. 15 is significantly less than the corresponding wider width w' of FIG. 16. FIG. 17 shows plate 92 with openings therein comprising rack opening 90 and slots 96.

As in the previous embodiments, the wider width insole assembly 78 forces the sides of the upper outward, thereby forcing the plug 64 downward and reducing the fitting height. This is accomplished without changing the girth of the shoe. Plate 92 is preferably of thin spring-tempered stainless steel. As in the previous embodiments, the wider adjustments correspond to a proper fit for the foot of lesser girth, while the narrower adjustments provide proper fit for wider feet. Materials preferred for other elements of the insole assembly 78 include a relatively firm durometer ethylene vinyl acetate of which the base element 80 would be preferably injection molded, while adjusting screw assembly 82 and rivets 94 would be of stainless steel or similar corrosion-resistant metal.

The embodiment of FIGS. 10–17 has several advantages over the other embodiments, including in being an integral part of the shoe and therefore not capable of being misused in shoes for which it was not designed to be used. Also, because of its infinite adjustability over its designed fitting range, it can afford a somewhat loose fit if so desired, as well as a quick, accurate and positive means of fit adjustment. This can be accomplished with the shoe on the foot, which is generally the preferred approach, particularly in competitive athletic usages where the wearer often does not have the time for the slower adjustment of laces and straps.

While this embodiment uses a rack and pinion arrangement together with a slidable movable adjustment plate and a somewhat deformable insole base, all interconnected, many other well-known approaches can be used to provide a similar insole midportional width-adjusting function and are therefore considered equivalents to the means disclosed. These equivalents include the use of spring means and/or bladder assemblies containing air and/or other gases, fluids or gels, with optional adjustment by conventional pump/valve assemblies well known in the art and currently in use in athletic shoes in the market.

One such embodiment is illustrated in FIGS. 18–22. Referring to the drawings, shoe 120 generally comprises upper 122 having a plug 124 attached at sewn seam 126 to vamp 128. Seam 126 extends substantially around the toe and along the midportion of upper 122 which is secured to unitsole bottom element 130 by a suitable means such as permanent sole-attaching adhesive cement. Disposed within the interior of shoe upper 122 is adjustment means 132 generally comprising insole assembly 134.

Insole assembly 134 comprises a socklining 136, preferably made of CAMBRELLE® shoe lining material from Faytex Corp., Braintree, Mass., a first bladder portion 138*a* generally disposed under the rearpart of the assembly at about the heel of the shoe, a second bladder portion 138*b* generally disposed under the forepart of the assembly at about the ball region of the shoe, the second bladder portion 138*b* has two side bladder extending portions 138*c* and 138*d* which extend substantially vertically along the sides of the shoe upper 124. The assembly 134 also comprises an adjustable pressurizable chamber 142 disposed between the first and second bladder portions 138*a* and 138*b*, and a tube 144 connecting bladder portions 138*a* and 138*b* to permit fluid flow therebetween. The tube 144 is generally disposed within a relatively dense compressible layer 148 underlying both bladder portions 138*a* and 138*b* and chamber 142. The tube 144 provides for fluid flow between bladders 138*a* and 138*b* through openings 146*a* and 146*b* in bladders 138*a* and 138*b*, respectively.

The first and second bladder portions 138*a* and 138*b* as well as pressurizable chamber 142, and tube 144 are each preferably made from a thermoplastic polyurethane material such as is available from the J. P. Stevens Company of Northampton, Mass. and others. Other suitable materials include elastomeric materials such as flexible polyvinyl chloride polymers and the like.

At least the second bladder portion 138*b* contains a generally open-cell polyurethane foam 154. The foam 154 causes the top surface 140*a* of the bladder portion 138*b* to move upwardly when the insole assembly is non-weightbearing when a foot of lesser girth is thereon. Such foams generally have a density of about 1.5 lb/ft$^3$ and are available from United Foam Plastics of Georgetown, Mass., and others. Other suitable foams include resilient open-cell polymers such as thermoplastic polyethylene and other such materials. Alternatively, a mechanical spring means may be used in place of or in conjunction with the foam. Such an open cell foam may also be placed in bladder 138*a*.

Tube 144 is generally disposed within layer 148 which is a dense compresible layer underlaying bladder portions 138*a* and 138*b* and chamber 142. Tube 144 effects fluid flow transport between bladder portions 138*a* and 138*b* through bladder openings 146*a* and 146*b* (in bladder portions 138*a* and 138*b*). Layer 148 is preferably a closed-cell polyurethane foam having a density of at least about 4 lb/ft$^3$ and available from United Foam Plastics and others. Alternatively, the function of tube 144 may be accomplished by using as layer 148 a non-porous closed cell material such as a suitable thermoplastic polyurethane polymer in which a channel has been formed.

During manufacture of the insole assembly 134, a pre-determined amount of a relatively incompressible fluid, such as medical grade mineral oil, glycerin, a silicone gel, or other material having similar flow properties, is enclosed within the two bladder portions 138*a* and 138*b*. The fluid must be of the type that will not diffuse through the walls of bladder portions 138*a* and 138*b* or tube 144. The fluid continually adjusts the fitting girth of the shoe 120 by flowing between the bladder portions 138*a* and 138*b* when the insole assembly is non-weightbearing, with such flow dictated by the size requirements of the foot therein, particularly in the ball, waist and instep regions thereof. The flow of the fluid between the bladder portions is effected by the pressure/amount of gas which has been introduced into the chamber 142 by means of an external pump (not shown). The pressure is controlled by the amount of gas inputted from the pump through a means such as a needle-valve inlet 150. Preferably, the pressure will be adjusted when the insole assembly is in the shoe by the wearer to his or her preference for comfort and function. Alternative pressure adjustment systems such as adjustably-tensioned springs and cylinder/piston arrangements are equivalent to needle-valve inlet 150.

The girthwise fit of a flexible shoe, particularly in the flexing ball region thereof, is controlled by regulating the flow of fluid between bladder portions in the forepart and rearpart of the insole assembly 134. Such fluid flow is urged selectively between the bladder portions by adjustable pressure means such that the foot in the shoe automatically re-adjusts the distribution of the fluid in the assembly during a stride cycle thereby adjusting the fit of the shoe on the foot when the shoe is not weightbearing. When a shod foot becomes air-borne during a stride, the insole assembly 134 automatically adjusts the fit of the shoe as fluid flows through tube 144 between bladder portions 138*a* and 138*b*, with the amount of fluid flow being in response to the pressure of the chamber 142 on the fluid in the system. The fluid is continually urged into filling the open-cells in the foam in bladder portion 138*b* as it expands vertically from its compressed weightbearing state. As the foot and shoe become weightbearing, the tube 144 flattens under load arresting the flow of fluid between bladder portions 138*a* and 138*b* and entrapping a correct amount of fluid in bladder portion 138*b* to adjust the proper fitting girth of the shoe to the wearer's foot therein. Upon each air-borne phase of the stride cycle, the system repeats its cyclical fit-adjusting function. Optionally, tube 144 may contain pressure activated valves (not shown, but well known in the art) to assist in fluid flow shut-off when the shoe or a portion thereof becomes weight-bearing.

Figure 19:
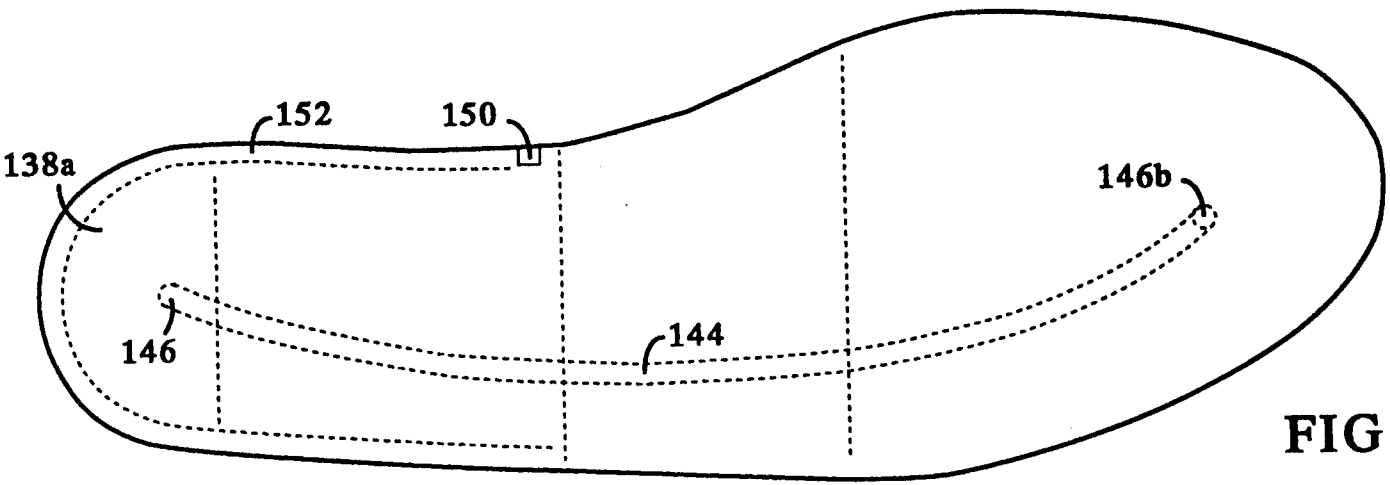
FIG. 19 is a plan view of the insole assembly of FIG. 18 as it appears viewed along line 19—19.

FIG. 19 shows the under-foot portions of the fluid assembly system, showing tube 144 and insole assembly rearpart foot-supporting wall 152, which is provided to prevent deformation of bladder portion 138*a* and chamber 142 under the heel of the foot when weightbearing. Optionally a "tuck element" (not shown) may be used for bridging and strengthening the backpart area of wall 152. A tuck element is prepared from a relatively firm fiber board material conventionally used in the backparts of shoes to strengthen and stiffen the area of the shoe from the heel to about the midportion. Such elements are available from LynFlex Co. of Scarboro, Me., and many others.

Figure 21:
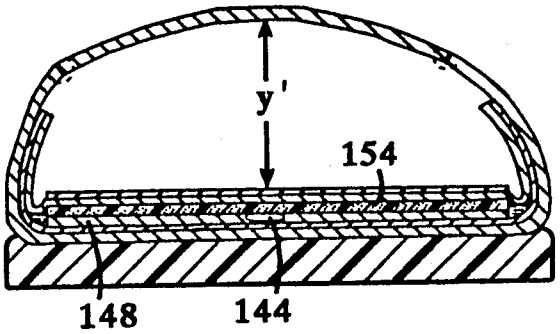
FIG. 21 is a plan view of the shoe of FIG. 18 taken on line 21—21 when the shoe is weightbearing and a foot of maximum girth is in the shoe.
Figure 20:
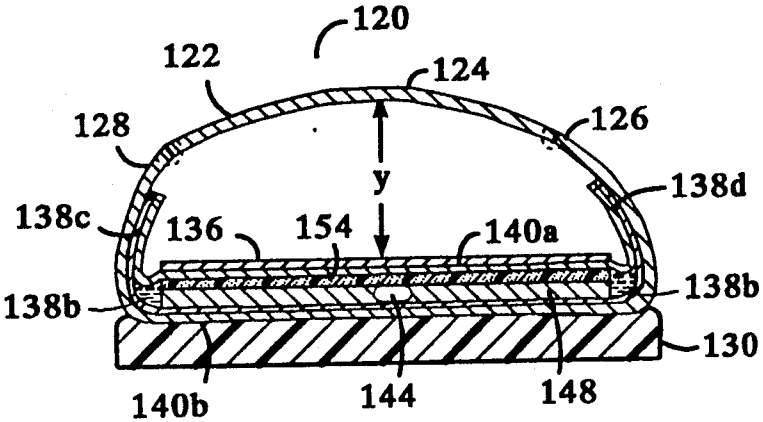
FIG. 20 is a plan view of the shoe of FIG. 18 taken on line 20—20 when the shoe is non-weightbearing and a foot of maximum girth is in the shoe.

As shown in FIG. 20, the shoe is in the attitude it would assume when non-weightbearing on a foot of substantially the maximum girth within the shoe's designed girth range. Almost all of the fluid contained within the bladder has moved out of the foam element 154 in bladder portion 138*b* and out of side bladder extension portions 138*c* and 138*d* back to rearpart bladder portion 138*a* due to the force exerted by the volume required due to the circumference of the foot. FIG. 21 shows the same shoe of FIG. 20 when it has become weightbearing. The weight has caused layer 148 and tube 144 contained therein to flatten to prevent any flow of fluid from rear bladder portion 138*a* into foreward bladder portions 138*b, c,* and *d*, until the shoe again becomes unweighted (during the stride). Weightbearing bladder side extension portions 138*c* and 138*d* are relatively empty of fluid. As a result, the vertical inside axis Y' of FIG. 21 is only slightly greater than the corresponding Y of FIG. 20, the difference being insufficient to appreciably affect the fit of the shoe 120. It should be noted that in both FIGS. 20 and 21, a minimum of fluid is in bladder portion 138*b* at any time during a stride cycle since all of the fluid had previously been forced back into bladder 138*a* by the presence of the maximum-girth foot in the shoe.

Figure 23:
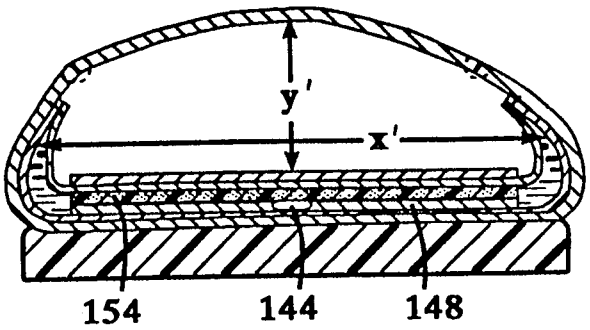
FIG. 23 is a plan view of the shoe of FIG. 18 taken on line 23—23 when the shoe is weightbearing and a foot of less than maximum girth is in the shoe.
Figure 22:
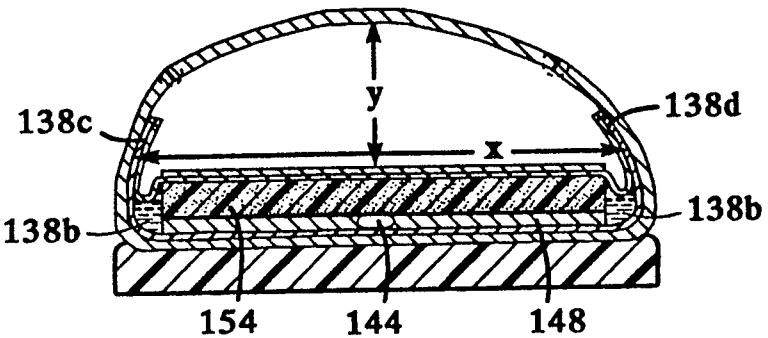
FIG. 22 is a plan view of the shoe of FIG. 18 taken on line 22—22 when the shoe is non-weightbearing and a foot of less than maximum girth is in the shoe.

FIGS. 22 and 23 parallel FIGS. 20 and 21 and show the same shoe 120 when worn on a foot of minimum girth within the shoe's designed girth range. FIG. 22 shows shoe 120 as it would appear when the foot therein is unweighted. It contains a large volume of fluid under the foot in foam element 154 in bladder portion 138*b* but a minimum of fluid in side bladder extensions 138*c* and 138*d*. When the shoe becomes weightbearing as in FIG. 23, the layer 148 and tube 144 flatten under the load arresting the flow of fluid back to bladder 138*a* and thus causing the fluid to flow upward into side bladder extensions 138*c* and 138*d*. This action expands the bladder extensions 138*c* and 138*d* and thereby causes the inside horizontal width of the constant girth shoe to expand from the width dimension X of FIG. 22 to the wider width dimension X' of FIG. 23. Since the circumference of the upper 122 is constant, any widening of the horizontal X axis must be accompanied by a corresponding shortening of the vertical Y axis, as the longer Y distance of FIG. 22 decreases to the lesser Y' of FIG. 23 which causes the plug 124 to remain in comfortably snug contact with the foot. Maintaining contact is most important in the ball area of the foot and immediately adjacent thereto where the flexible shoe needs to flex during the stride. Any unnecessary looseness of the upper on the foot at this area can cause unsightly and uncomfortable buckling of the upper as well as adversely effecting the fit of the shoe.

An advantage of this embodiment is that the deformation which adjust the girth of the shoe to a foot therein occurs primarily when the shoe is weightbearing. This improves the appearance of the shoe when it is non-weightbearing, as on display at point of sale or when a wearer is seated.

What is claimed is:

1. A shoe comprising a bottom member, an upper member having two opposing side portions and a top portion, said bottom and upper members defining an enclosure, and an adjustment means disposed within the enclosure adjacent and along at least a portion of the bottom member, said adjustment means and said upper member defining a cavity for insertion of a foot, said shoe having a heel portion, a midportion and a toe portion, said cavity having a width extending between the two side portions at about the midportion of the shoe and also having a fitting height extending vertically from the adjustment means to the top portion of the upper member within the cavity at about the midportion, said cavity also having a defined circumference at about the midportion, said adjustment means being disposed in a position for changing the relationship between the width of the cavity and the fitting height of the cavity while maintaining the defined circumference substantially constant so as to improve the fit of the shoe, wherein said adjustment means comprises a fluid-containing bladder.

2. The shoe of claim 1, wherein the bladder contains at least two portions, said portions being connected to each other by a connecting means disposed therebetwen permitting fluid flow therebetween.

3. The shoe of claim 2, wherein the connecting means is collapsable under the weight of a foot during a stride.

4. The shoe of claim 2, wherein the connecting means is a channel.

5. The shoe of claim 2, wherein the connecting means is a tube.

6. The shoe of claim 2, wherein one portion of the bladder is rearward of the midportion of the shoe.

7. The shoe of claim 6, wherein a second portion of the bladder is forward of the first portion of the bladder and contains a foam in which the fluid is dispersed.

8. The shoe of claim 7, wherein the second portion of the bladder has a side extension on each side thereof.

9. The shoe of claim 1, wherein the adjustment means deforms the upper to a lesser degree when the shoe is non-weight-bearing than when the shoe is weightbearing.

10. The shoe of claim 1, wherein the fluid is a mineral oil, glycerin, or a silicone gel.

* * * * *